US006900823B2

(12) United States Patent
Nishimura

(10) Patent No.: US 6,900,823 B2
(45) Date of Patent: May 31, 2005

(54) THERMAL PRINTER AND METHOD OF CLEANING THERMAL HEAD

(75) Inventor: Tomoyoshi Nishimura, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 75 days.

(21) Appl. No.: 10/668,278

(22) Filed: Sep. 24, 2003

(65) Prior Publication Data

US 2004/0061768 A1 Apr. 1, 2004

(30) Foreign Application Priority Data

Sep. 25, 2002 (JP) ..... 2002-279594

(51) Int. Cl.[7] ..... B41J 2/32
(52) U.S. Cl. ..... 347/171
(58) Field of Search ..... 347/171, 220, 347/221; 400/701, 702; 428/32.66; B41J 2/325

(56) References Cited

U.S. PATENT DOCUMENTS 5,143,782 A * 9/1992 Morishima et al. ..... 428/32.66
6,271,872 B1 * 8/2001 Nagata ..... 347/171

FOREIGN PATENT DOCUMENTS

| | | | |
|---|---|---|---|
| JP | 58-197070 | 11/1983 | |
| JP | 8-336998 | 12/1996 | |
| JP | 10-100365 | 4/1998 | |
| WO | WO93/21020 | * 10/1993 | ..... B41J/2/325 |

* cited by examiner

*Primary Examiner*—K. Feggins
(74) *Attorney, Agent, or Firm*—Sughrue Mion, PLLC

(57) ABSTRACT

A heating element array is cleaned in case foreign matters are adhered or deposited to a thermal head, such as after printing. A color thermal recording paper is fed in a state that the thermal head is heated not so as to develop a cyan thermosensitive coloring layer. After that, a cleaning portion and the heating element array are in slidable contact with each other, so that the heating element array is cleaned. The cleaning portion used for the cleaning treatment is cut away and discharged through a delivery opening.

20 Claims, 6 Drawing Sheets

FIG.1A
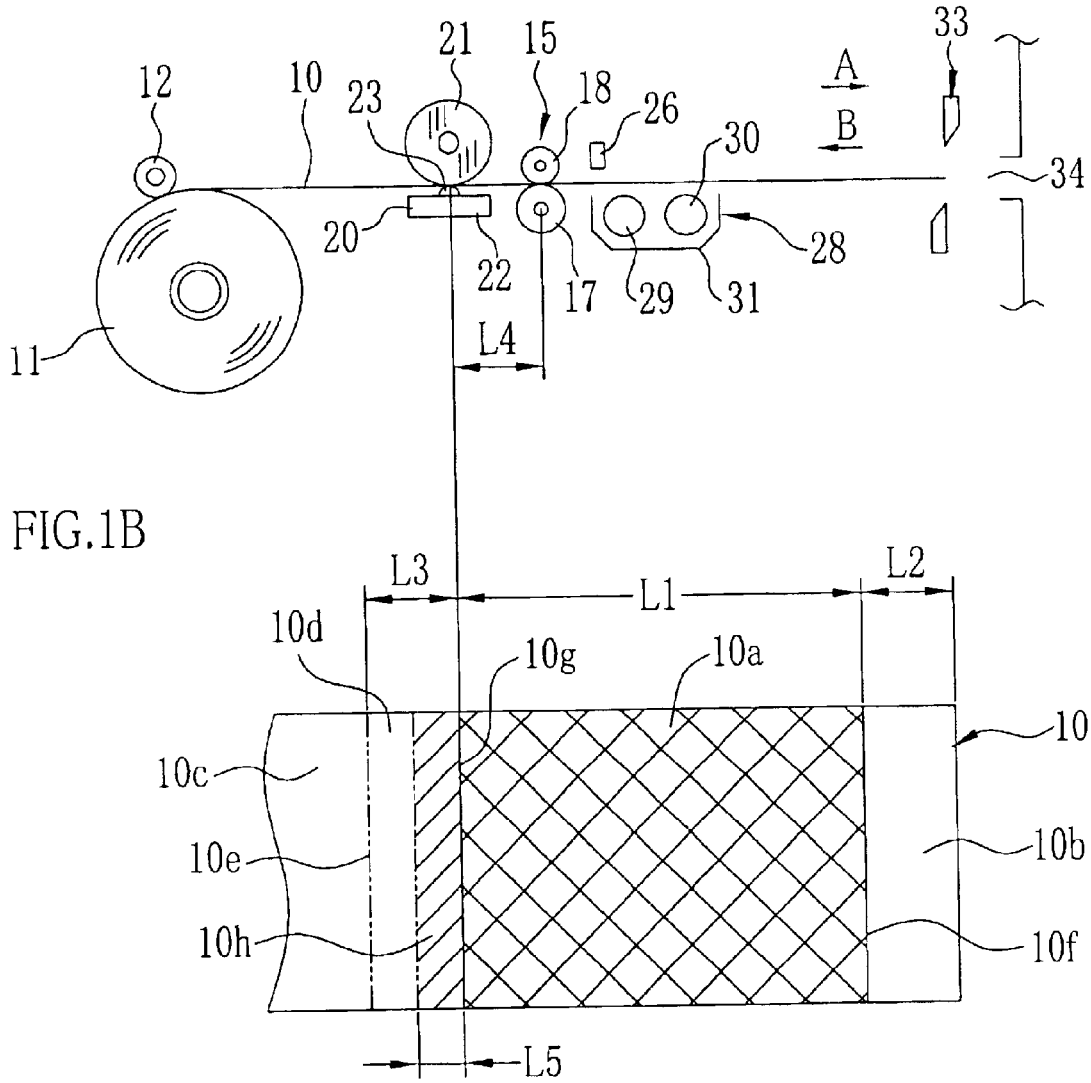
FIG.1B
FIG.1C
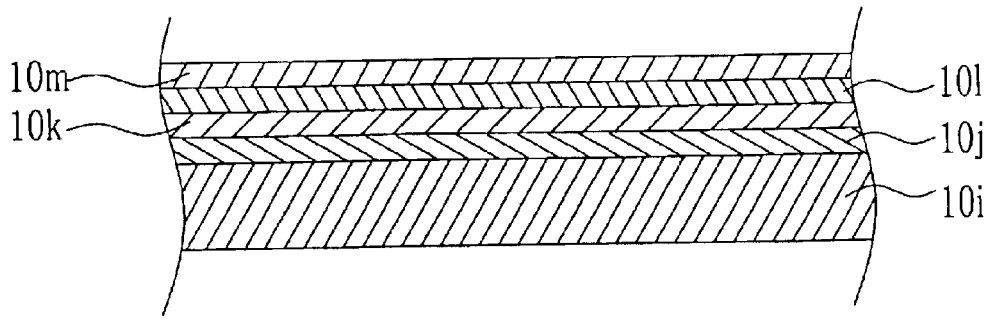

THERMAL PRINTER AND METHOD OF CLEANING THERMAL HEAD

BACKGROUND OF THE INVENTION

1. Field of the Invention

The present invention relates to a thermal printer and a method of cleaning a thermal head thereof.

2. Description of the Prior Arts

A color thermal printer prints a full color image on a color thermal recording paper. The color thermal recording paper includes yellow, magenta, cyan thermosensitive coloring layers overlaid in sequence. Except for the cyan thermosensitive coloring layer, other thermosensitive coloring layers have a fixing property. While the recording paper is fed, a heating element array of a thermal head is pressed against the recording paper so that each heating element generates heat, and then three-color images are recorded in frame-sequential fashion by the heating. Ultraviolet rays having a peculiar wave-length range relative to each thermosensitive coloring layer are applied to the yellow and magenta thermosensitive coloring layers to fix the recorded image.

If the printing is continuously carried out, foreign matters are adhered or deposited to the heating element array, for example dust adhered to a printing surface of the recording paper, peeled matters peeled from a protective layer, which covers the printing surface of the recording paper, paper dust, and so on. If the printing is performed in a state the foreign matters are adhered to the thermal head, heat transfer is impeded so that the print image quality is degraded. If the thermal head is caused to preheat before printing, the adhered foreign matters are fixed to the heating element array by application of the heat, and therefore the contamination of the thermal head is deteriorated.

Accordingly, the color thermal printer should be regularly cleaned. In the prior art, a cleaning sheet is set in the printer instead of the color thermal recording paper, and then it is rubbed against the heating element array, so that the foreign matters adhered to the heating element array are eliminated. Japanese Patent Laid-Open Publication No. 10-100365 discloses the method of eliminating the foreign matters from the thermal head every printing. The ability of eliminating the foreign matters is subsidiary in comparison with the case in which the cleaning sheet is used. In this method, the foreign matters are wiped away from the heating element array by feeding the recording material in a state that the heating element array in an off-state is pressed against the recording material after printing.

However, as shown in FIG. 7, since the unheated color thermal recording paper 2 is hard, even if the color thermal recording paper 2 is pushed by a platen roller 4, a contact width W1 between the heating element 3 and the color thermal recording paper 2 is narrow. Thereby, the heating element 3 and the color thermal recording paper 2 are contacted with each other only in an upstream side part in the feeding direction of the recording paper. Therefore, it is not possible to eliminate the foreign matter 5 adhered to a downstream side part in the feeding direction of the recording paper.

There is also a known printer which is used with the rolled color thermal recording paper. When the power is turned off, a power turn-off operation is performed to rewind the unused recording paper to a roll. If paper jamming occurs when rewinding the recording paper, the foreign matters, which are adhered to the platen, are moved to the heating element array due to maintenance when the paper jamming has been occurred or when the recording paper and the heating element array have been scraped with each other in the paper jamming. If a reset operation is performed in order to fix an error occurred in the printer, an initializing operation for restoring an initial state of the printer is performed. In the initializing operation, since the heating element array and the platen are contacted with each other, the foreign matters adhered to the platen are moved to the heating element array.

Likewise, dust penetrating into the printer in exchanging or supplying the recording paper, paper dust, a printing residue and the like are also adhered to the heating element array. In Japanese Patent Laid-Open Publications No. 10-100365, since the heating element array is cleaned after printing, it is not possible to remove the foreign matters, which have been adhered to the heating element array after cleaning. Therefore, there arises a problem in that the foreign matters are fixed to the heating element array by preheating prior to printing so that the contamination is deteriorated.

SUMMARY OF THE INVENTION

An object of the present invention is to provide a method of cleaning a thermal head easily and also in an effective manner.

Another object of the present invention is to provide a thermal printer in which it is possible to prevent foreign matters adhered or deposited to a heating element array of the thermal head from fixing thereto by heating.

In order to achieve the above and other objects, after the image has been recorded on the recording area, a heating element array is cleaned by coming in slidable contact with the outside of a recording area of a thermal recording material. During the cleaning of the thermal head, the heating element array is heated at cleaning temperature wherein each color of the thermal recording material is not developed. The thermal recording material includes at least yellow, magenta, and cyan thermosensitive coloring layers, and a protective layer. The cleaning temperature is preferably determined in lower than intermediate temperature at a median level between temperature for softening the protective layer and temperature for developing the cyan thermosensitive coloring layer to the maximum density. In a printer which is used with a rolled recording paper, a cleaning portion of the recording material is used for cleaning of the thermal head. The cleaning portion of the recording material exists between the recording area in which the image has been already recorded and the recording area to be printed subsequently. After cleaning of the thermal head, this cleaning portion is cut away from the recording material, and then discarded.

In a first embodiment of the present invention, when a power is turned off, a power turn-off operation for rewinding the thermal recording material to a paper roll is performed. Meanwhile, when the power is turned on, a power turn-on operation for leading the recording paper from the paper roll is performed. When the power turn-off operation has not been normally completed or terminated, each step of the cleaning method is executed after the power turn-on operation. In a second embodiment of the present invention, when the power turn-off operation has been normally completed, the heating element array is preheated, and then printing on the recording area is started. On the other hand, when the power turn-off operation has not been normally completed, the printing on the recording area is started without preheating the heating element array.

In a third embodiment of the present invention, after the heating element array and the platen have been in contact with each other by performing the initializing operation for restoring the initial state of the thermal head, after resetting of error, or after exchanging of the thermal recording material, each step of the cleaning method is executed. In a forth embodiment of the present invention, in the normal printing, the printing on the recording area is started after preheating of the heating element array. Meanwhile, the printing on the recording area is started without preheating the heating element array after the heating element array and the platen have been in contact with each other by performing the initializing operation for restoring the initial state of the thermal head, after resetting of the error, or after exchanging of the recording material.

The thermal printer of the present invention includes checking means for checking whether the power turn-off operation has been normally completed or terminated and a termination state memory for storing the information that the power turn-off operation has been completed. The thermal printer further comprises controller for performing cleaning of the thermal head when the checking means judges that the power turn-off operation has not been normally completed in accordance with the information stored in the termination state memory, or when the printing on the recording area has been completed. In another embodiment of the thermal printer, the controller is operated to judge whether the thermal head should be preheated in accordance with the information stored in the termination state memory, and therefore, the controller is operated to preheat the thermal head when the power turn-off operation has been normally completed, whereas the controller is not operated to preheat the thermal head when the power turn-off operation has not been normally completed.

According to the present invention, since the cleaning portion of thermal recording material is used for cleaning of the heating element array, it is possible to perform the cleaning easily and at low cost. In case dust is adhered or deposited to the heating element array, the cleaning is performed before printing, or the preheating prior to printing is stopped, so that the dust is not fixed to the heating element array by application of heat in printing.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein:

FIG. 1A is an outline view of a color thermal printer to which the present invention is applied;

FIG. 1B is an explanatory view showing a recording state on a color thermal recording material;

FIG. 1C is a sectional view of the color thermal recording material;

DETAILED DESCRIPTION OF THE PREFERRED EMBODIMENTS

Figure 2:
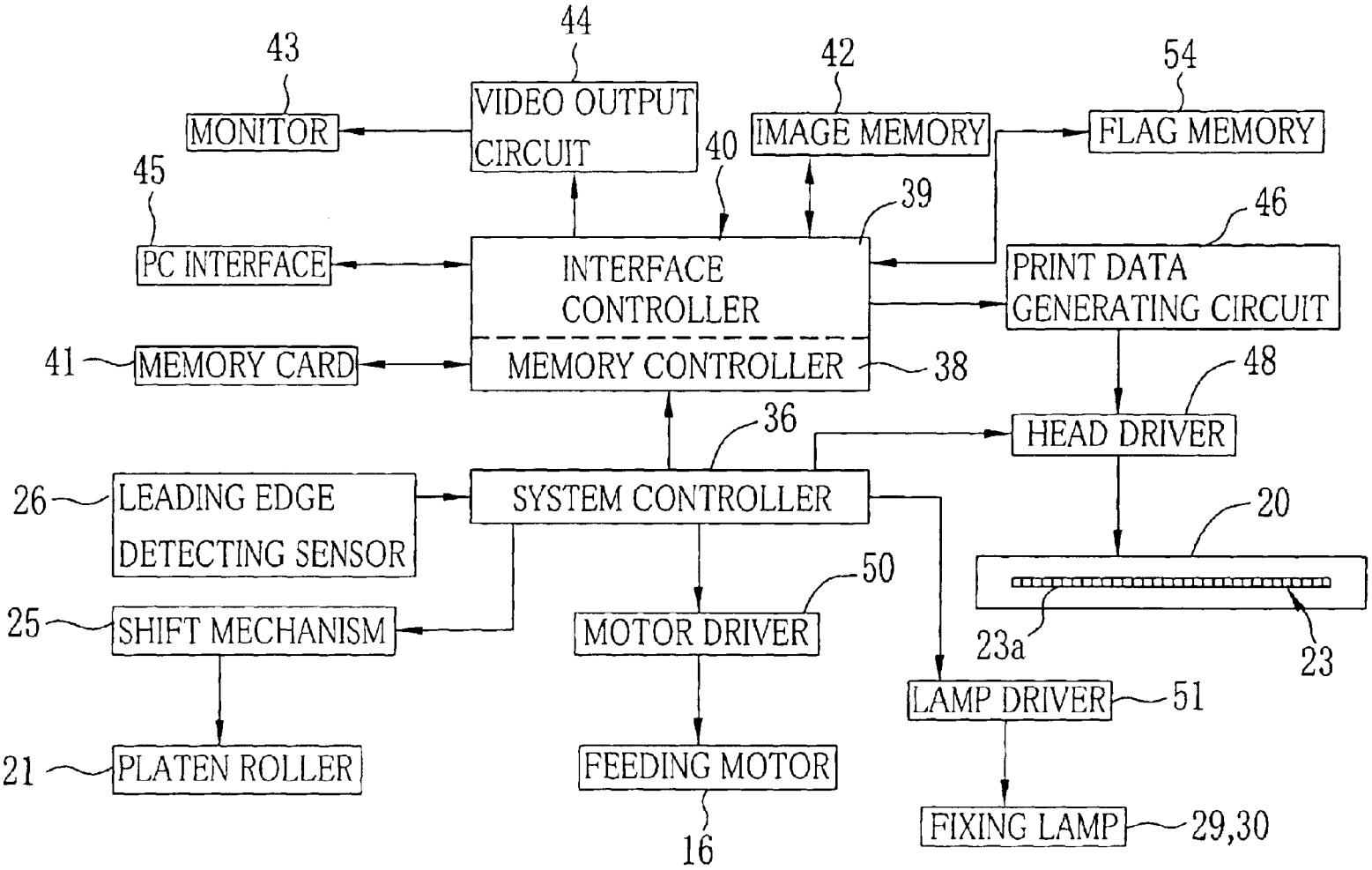
FIG. 2 is a block diagram showing an electric constitution of the color thermal printer.

As shown in FIG. 1A, a color thermal printer is used with a long color thermal recording paper 10 as a recording media. The color thermal recording paper 10 is wound into a roll shape and loaded into the color thermal printer as a recording paper roll 11. The recording paper roll 11 is rotated by a feeder roller 12, which is in contact with an outer periphery thereof. In FIG. 1A, the color thermal recording paper 10 is reciprocally fed by the feeder roller 12 in an advancing direction (A direction), which is the rightward direction of the drawing, and in a withdrawing direction (B direction), which is the leftward direction of the drawing.

As shown in FIG. 1C, the color thermal recording paper 10 includes a cyan thermosensitive coloring layer 10*j*, a magenta thermosensitive coloring layer 10*k*, a yellow thermosensitive coloring layer 10*l*, and a protective layer 10*m* overlaid on a support medium 10*i* in sequence. The yellow thermosensitive coloring layer 10*l* is the farthest from the support medium 10*i* and has the highest heat sensitivity. The yellow thermosensitive coloring layer 10*l* develops the yellow color by application of relatively low heat energy. The cyan thermosensitive coloring layer 10*j* is the closest to the support medium 10*i* and has the lowest heat sensitivity. The cyan thermosensitive coloring layer 10*j* develops the cyan color by application relatively high heat energy. The yellow thermosensitive coloring layer 10*l* loses its coloring ability when visible violet rays (electro-magnetic radiations) of 420 nm are applied thereto. The magenta thermosensitive coloring layer 10*k* develops the magenta color by application of medium heat energy, and loses its coloring ability when ultraviolet rays (electro-magnetic radiations) of 365 nm are applied thereto.

Feeder roller pairs 15 are disposed downstream in the A direction of the recording paper roll 11. The feeder roller pairs 15 convey the color thermal recording paper 10 while sandwiching it between the specific two rollers. The feeder roller pairs 15 are constituted of a capstan roller 17 and a pinch roller 18. The capstan roller 17 is rotated by a feeding motor 16 (see FIG. 2). The pinch roller 18 is pushed against the capstan roller 17. The color thermal recording paper 10 is reciprocally fed by the feeder roller pairs 15 in the A direction and the B direction. The color thermal recording paper 10 is nipped by the pinch roller 18 moved by a shift mechanism (not shown).

A thermal head 20 and a platen roller 21 are disposed upstream in the A direction of the feeder rollers 15 so as to hold a feeding path for the color thermal recording paper 10 in between. The thermal head 20 is constituted of a head substrate 22 made from metal excellent in heat conductivity and a heating element array 23 formed on a top surface of the head substrate 22. The heating element array 23 includes a large number of heating elements (see FIG. 2) arranged linearly along a main scanning direction perpendicular to the feeding direction. The length of the heating element array 23 is larger than a width dimension of the color thermal recording paper 10, so as to print on the entire recording area of the color thermal recording paper 10 in the width direction.

The platen roller 21 is disposed above the feeding path in opposition to the heating element array 23. A shift mechanism 25 (see FIG. 2), such as a cam, a spring, a solenoid, and so forth moves the platen roller 21 between a recording position where the platen roller 21 is pressed against the heating element array 23 and a separating position where the platen roller 21 is separated from the heating element array 23.

The thermal head 20 is pressed against the color thermal recording paper 10 advanced in the A direction, and then each heating element 23*a* is driven to heat and develop the thermosensitive coloring layers selectively. The platen roller 21 is rotated in accordance with the feeding of the color thermal recording paper 10.

A leading edge detecting sensor 26 is disposed above the feeding path and on the downstream side in the A direction of the feeder roller pairs 15. The leading edge detecting sensor 26 detects a leading edge of the color thermal recording paper 10 when the color thermal recording paper 10 is advanced. As the leading edge detecting sensor 26, it is possible to use a reflective photo interrupter provided with both a light emitting part for emitting inspection light to the edge of the color thermal recording paper 10 and a light receiving part for receiving the inspection light reflected by the color thermal recording paper 10.

An optical fixer 28 is disposed below the feeding path and on the downstream side in the A direction of the feeder roller pairs 15. The optical fixer 28 includes a yellow fixing lamp 29, a magenta fixing lamp 30, and a reflector 31. The yellow fixing lamp 29 emits visible violet rays of which the wavelength peaks at 420 nm to fix the yellow thermosensitive coloring layer 10*l*. The magenta fixing lamp 30 emits ultraviolet rays of which the wavelength peaks at 365 nm to fix the magenta thermosensitive coloring layer 10*k*.

A cutter device 33 is provided in the downstream side in the A direction of the optical fixer 28. The cutter device 33 is operated to cut the long color thermal recording paper 10 every recording area. A delivery opening 34 for discharging the color thermal recording paper 10 cut into a sheet is disposed downstream from the cutter device 33.

In FIG. 2, the color thermal printer is controlled by a system controller 36. The system controller 36 is constituted of a CPU, a program ROM, a work RAM, and so forth. The CPU controls each section in the printer in accordance with control program stored in the ROM. The data generated upon operation of the CPU is temporally stored the work RAM.

The system controller 36 is connected with an IC (integrated circuit) 40 in which a memory controller 38 and an interface controller 39 are mounted. The memory controller 38 controls both a memory card 41 and an image memory 42, and further reads/writes image data. The memory card 41 is loaded in a memory card slot from outside of the printer. The interface controller 39 controls a PC interface 45, a video output circuit 44, and so forth. The PC interface 45 is used for connecting with a personal computer, a digital camera, and so forth. The video output circuit 44 outputs the image on an external monitor 43.

If the image data recorded in the memory card 41 is displayed on the monitor 43, the memory controller 38 is operated to read the image data from the memory card 41, and thereafter, the interface controller 39 inputs the image data in the video output circuit 44. The video output circuit 44 converts the image data having RGB format to a composite signal, for example NTSC and so forth, and then outputs to the monitor 43.

In addition, if the image data stored in the memory card 41 is printed, the image date in the memory card 41 is read by the memory controller 38, and then recorded in the image memory 42. The image data recorded in the image memory 42 is transmitted to a print data generating circuit 46 through the memory controller 38.

The print data generating circuit 46 converts the image data having the RGB format into the print data having YMC format. The print data is input in a head driver 48 every line for each color. The head driver 48 converts the print data in every line into a driving signal to drive each heating element of the thermal head 20.

A motor driver 50, a lamp driver 51, and the shift mechanism 25 are connected with the system controller 36. The motor driver 50 generates a driving pulse for driving the feeding motor 16 as a stepping motor in accordance with the control signal from the system controller 36. The driving pulse generated in the motor driver 50 is counted in the system controller 36, and used for detecting a feeding amount of the color thermal recording paper 10.

The yellow fixing lamp 29 and the magenta fixing lamp 30 are turned on and turned off by the lamp driver 51 in response to the control signal transmitted from the system controller 36, so that the yellow thermosensitive coloring layer 101 and the magenta thermosensitive coloring layer 10*k* are fixed.

A termination state flag memory 54 is connected with the IC 40. When the color thermal printer is turned off, power-off operation is performed to rewind the unused color thermal recording paper 10 to the recording paper roll 11. Note that the system controller 36 also constitutes checking means which checks whether the power-off operation has been normally completed or terminated. When the power-off operation has been normally completed, the system controller 36 is operated to turn off the power after storing a normal flag "1" in a flag memory 54. The normal flag "1" shows that the power-off operation has been normally completed. Whereas, in case malfunction occurs in the power-off operation, for example in case the paper jamming occurs, the power is turned off after storing of a failure flag "0" in the flag memory 54.

Figure 3:
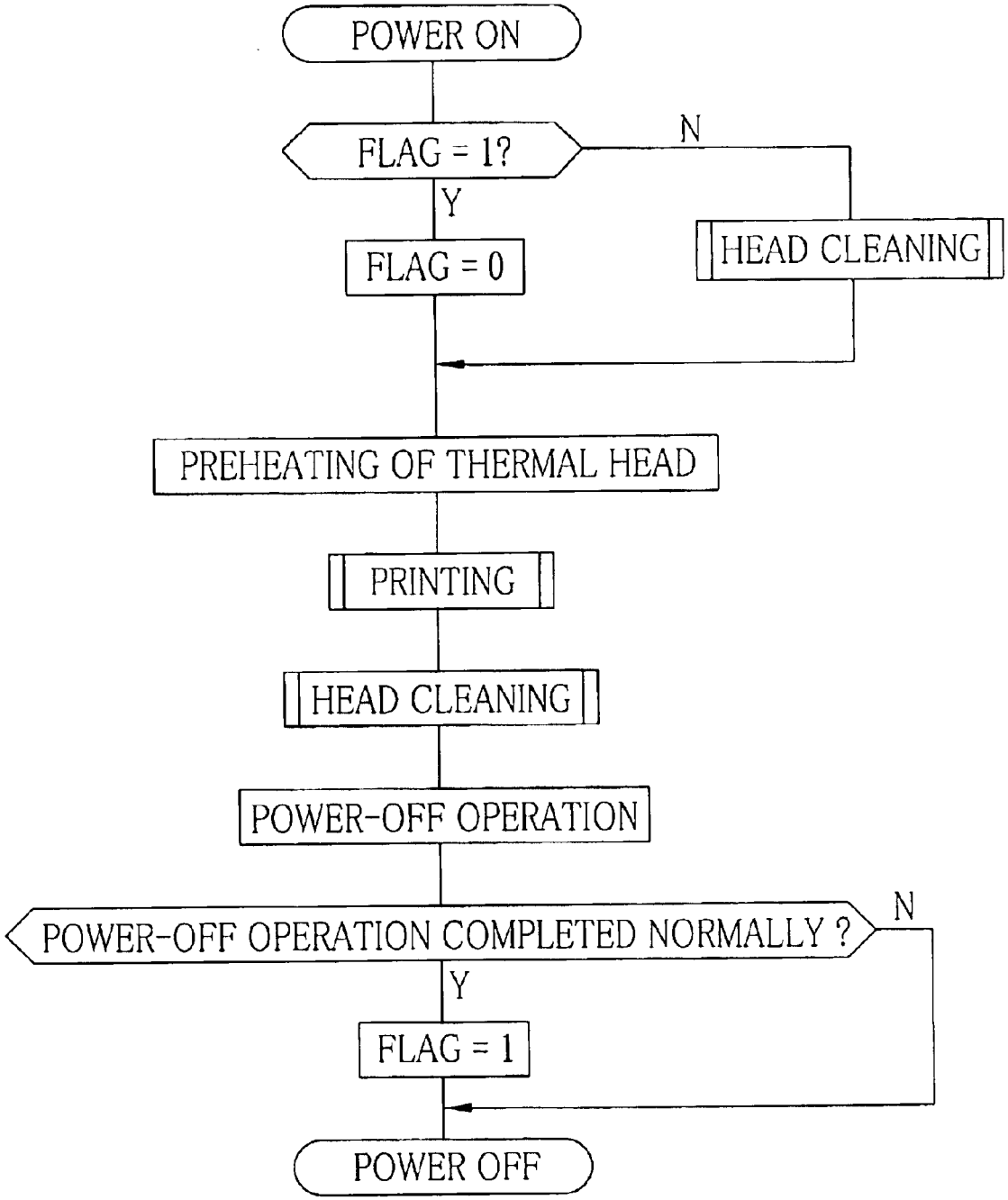
FIG. 3 is a flow chart showing operation procedures for the color thermal printer.
Figure 4:
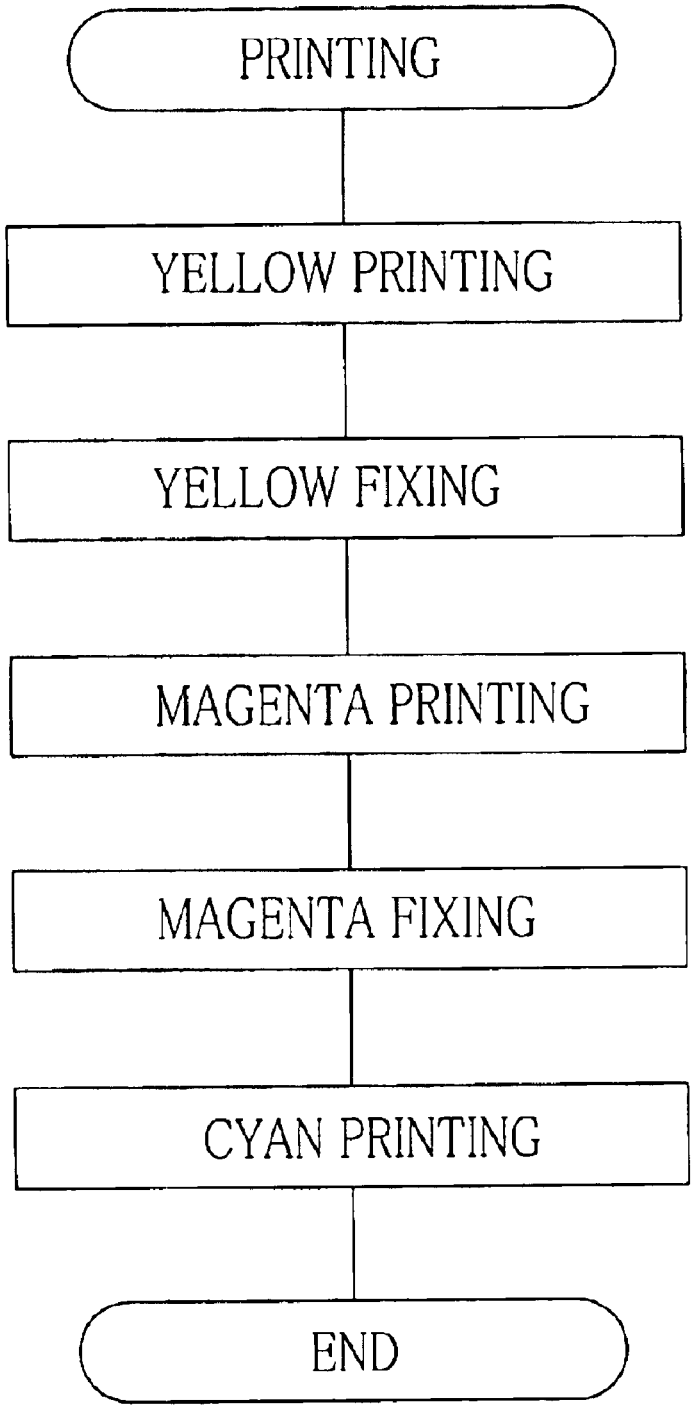
FIG. 4 is a flow chart showing operation procedures for printing.
Figure 5:
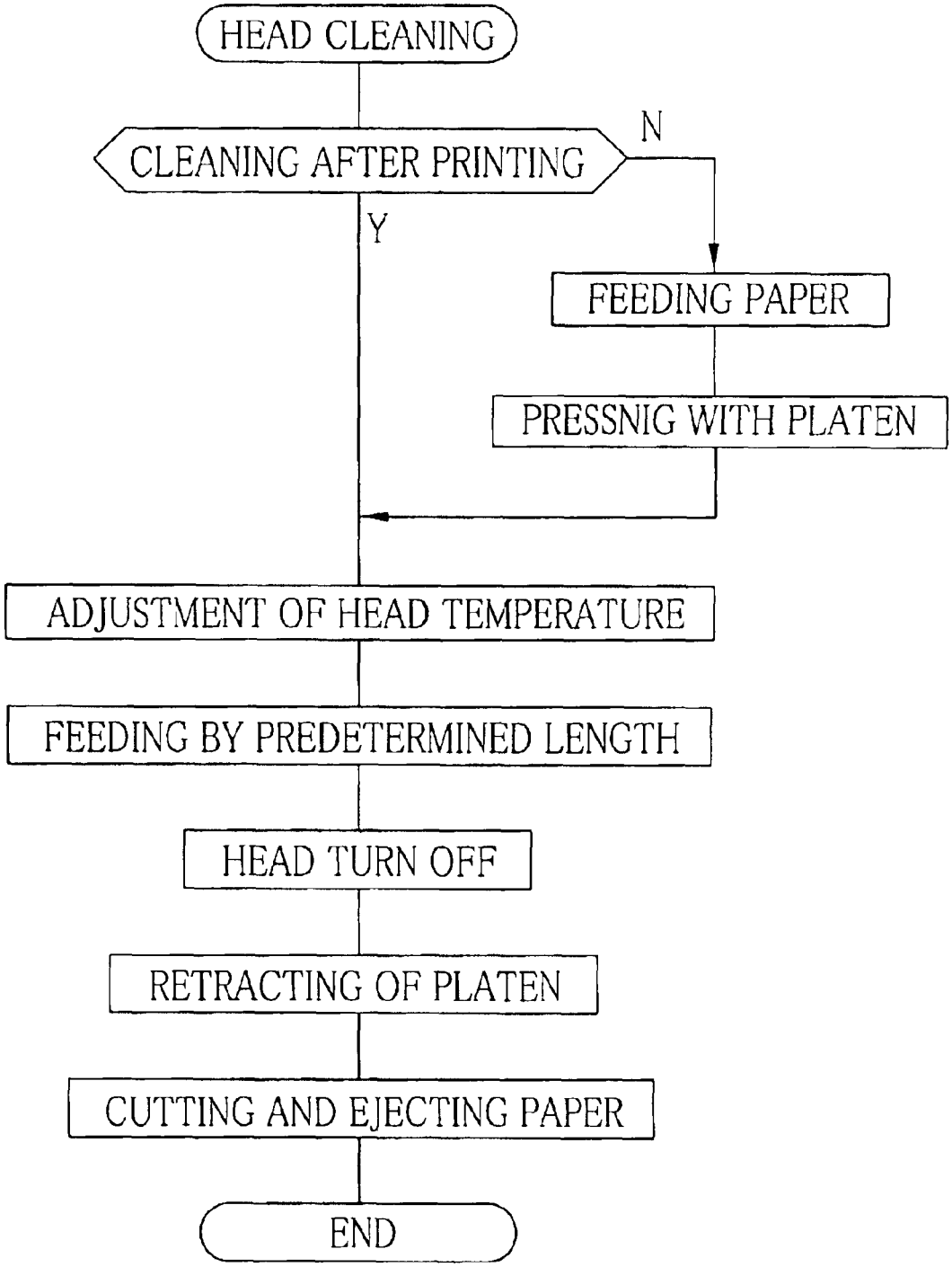
FIG. 5 is a flow chart showing operation procedures for cleaning a thermal head.

Next, the operation of the above embodiment is explained in reference to the flow charts in FIG. 3–FIG. 5. When the power of the color thermal printer is turned on, the system controller 36 checks the stored information in the flag memory 54. If the normal flag "1" is stored in the flag memory 54, since the normal flag 54 shows that the previous power-off operation has been normally completed, it is possible to start the printing preparing operation. When the power of the color thermal printer 10 is turned off, in order to store the state in the power-off operation in the flag memory 54, the previous stored information is deleted after checked.

The thermal head 20 is driven for preheating after the system controller 36 has energized the heating element array 23 through the head driver 48 in a state that the thermal head 20 has been separated from the color thermal recording paper 10. Since the previous power-off operation has been normally completed, dust, fine particles, or any unwanted foreign matters are not adhered or deposited to the heating element array 23. Accordingly, the foreign matters are not fixed to the heating elements array 23 by preheat of the thermal head 20.

The image data stored in the memory card 41 is read out by the memory controller 38, and then the image is displayed on the monitor 43 by the video output circuit 44. The user selects the image displayed on the monitor 43 and indicates which of the images is printed.

Thereafter, the system controller 36 controls the motor driver 50 and starts the rotation of the feeding motor 16. As shown FIG. 1A, the feeding motor 16 rotates the feeder roller 12 in a counter clockwise direction in the drawing. The recording paper roll 11 contacting with the periphery of the feeder roller 12 is rotated in a clockwise direction to advance the leading edge of the color thermal recording paper 10 to the feeding path.

When the leading edge of the color thermal recording paper 10 has reached between the capstan roller 17 and the pinch roller 18 in the feeder roller pairs 15, the leading edge detecting sensor 26 inputs the detecting signal in the system controller 36. After the system controller 36 has received the detecting signal from the leading edge detecting sensor 26, the color thermal recording paper 10 is nipped by the feeder roller pairs 15 while the rotation of the feeding motor 16 is stopped by the motor driver 50. Thereafter, the platen roller 21 is moved in the recording position by the shift mechanism 25.

The feeding motor 16 is rotated by the system controller 36, and thereby the color thermal recording paper 10 is advanced to the A direction again. At the same time, the head driver 54 is controlled, and then each heating element 23*a* of the heating element array 23 is caused to generate heat, so that the yellow image is recorded on a range between a front edge 10*f* and a rear edge 10*g* of a recording area 10*a* line by line.

A nip margin 10*b* is provided adjacent to the front edge 10*f* of the recording area 10*a*. The nip margin 10*b* is used when the color thermal recording paper 10 is fed by the feeder roller pairs 15. In a similar manner, a nip margin 10*d* is provided adjacent to the rear edge 10*g* of the recording area 10*a,* and used when the image is recorded on a second recording area 10*c*. The lengths L2 and L3 of the respective nip margins 10*b* and 10*d* have the same length as length L4, which is a distance between the feeder roller pairs 15 and the thermal head 20.

If the color thermal recording paper 10 is advanced by length L1 in the A direction to record the yellow image, the system controller 36 moves the platen roller 21 to the separating position. After the color thermal recording paper 10 has been advanced so as to bring a rear edge 10*e* of the nip margin 10*d* in the A direction to face the optical fixer 28, the rotation of the feeding motor 16 is stopped. After that, the feeding motor 16 is rotated in a backward direction so as to withdraw the color thermal recording paper 10 in the B direction. At the same time, the yellow fixing lamp 29 is turned on to fix the yellow thermosensitive coloring layer 10*l*. The recording area 10*a* is fixed together with the nip margin 10*d* in order to increase an integrated light quantity of the ultraviolet rays in the rear edge of the recording area 10*a* in the B direction.

When the recording area 10*a* and the yellow thermosensitive coloring layer 10*l* of the nip margin 10*d* has been completely fixed, the yellow fixing lamp 29 is turned off by the system controller 36. When the front edge 10*f* of the recording area 10*a* has been faced to the thermal head 20, the rotation of the feeding motor 16 is stopped.

After that, in a similar manner of the yellow image, the magenta and cyan images are recorded and fixed as shown in the flow chart in FIG. 4.

After recording on the recording area 10*a,* the cleaning treatment of the thermal head 20 is started as shown in the flow chart in FIG. 5. Firstly, the system controller 36 energizes the heating element array 23, and then the temperature is adjusted and set at a cleaning temperature of a level short of developing the cyan thermosensitive coloring layer. The heating element array 23 is heated at intermediate temperature at a median level or average level between temperature for softening the printing surface of the color thermosensitive recording paper 10 and temperature for developing the cyan thermosensitive coloring layer to the highest density.

Figure 6:
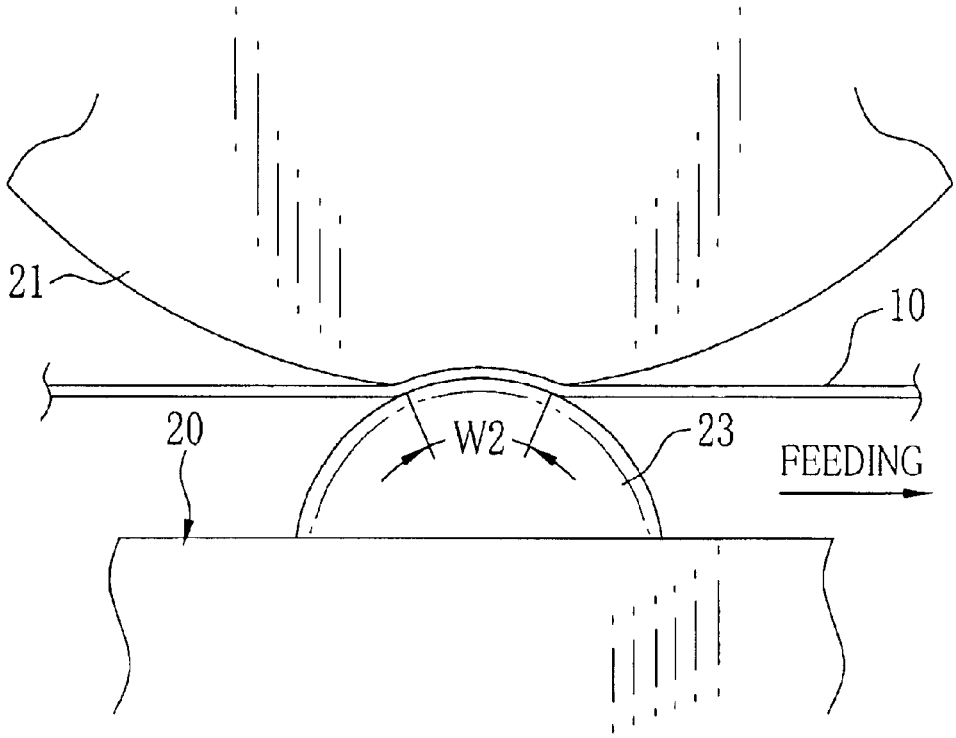
FIG. 6 is an explanatory view showing a contact state between a heating element and the color thermal recording materials in cleaning treatment.
Figure 7:
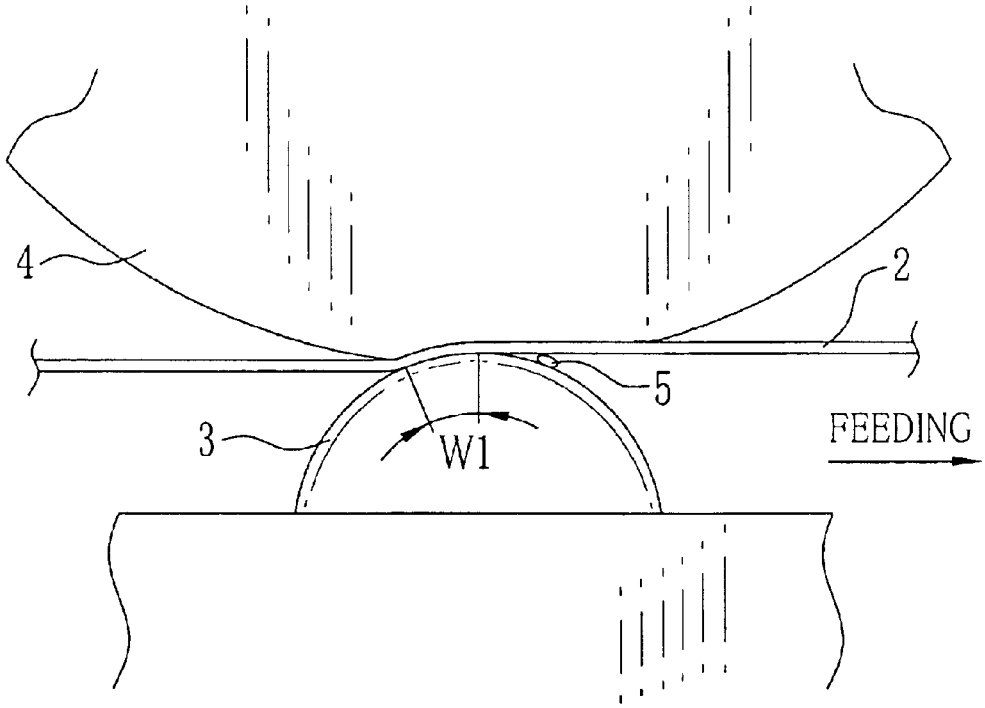
FIG.7 (PRIOR ART)
FIG. 7 is an explanatory view showing a contact state between a heating element and the color thermal recording material in prior art cleaning treatment.

Secondly, the feeding motor 16 is rotated so as to advance the color thermal recording paper 10 in the A direction by a length L5, so that a cleaning portion 10*h* in the nip margin 10*d* is in slidable contact with the heating element array 23. The length L5 is 10 mm, for example. As shown in FIGS. 6 and 7, since a contact width W2 between the color thermal recording paper 10 softened by heat and the heating element array 23 is larger than a contact width W1 when the recording paper is not heated, so that foreign matters adhered or deposited to the heating element array 23 can be surely eliminated in a wider range. In the cleaning treatment, the yellow thermosensitive coloring layer 10*l* and the magenta thermosensitive coloring layer 10*k* in the nip margin 10*d* are fixed, which means that nothing seems to be recorded thereon.

When the color thermal recording paper 10 has been advanced by the length L5, the supply of the power to the thermal head 20 is stopped. The platen roller 21 is moved to the separating position by the shift mechanism 25. The color thermal recording paper 10 is further advanced in the A direction to be cut at the front edge 10*f* by the cutter device 33, so that the nip margin 10*b* is removed. Thereafter, the color thermal recording paper 10 is further advanced to be cut at the rear edge 10*g*. Thereby, the recording area 10*a* is separated from the long color thermal recording paper 10, and discharged from the delivery opening 34.

When the next printing is indicated, the color thermal recording paper 10 is withdrawn in the B direction, while the yellow image is recorded thereon. Thereafter, as aforementioned, the magenta and cyan images are also recorded; the cleaning treatment of the thermal head is performed; and the recording area is cut away.

If the power is turned off, the system controller 36 is operated to separate the pinch roller 18 from the color thermal recording paper 10, and reverse the feeder roller 12 so as to rewind the color thermal recording paper 10 to the recording paper roll 11. The system controller 36 checks whether the power-off operation has been normally completed. When the power-off operation has been normally completed, the normal flag "1" is written in the flag memory 54, and then the power is turned off. Whereas, when the power-off operation has not been normally completed by occurrence of the paper jamming in rewinding the color thermal recording paper 10, the failure flag "0" is written in the flag memory 54, and then the power is turned off.

The foreign matters may be adhered to the heating element array 23 due to maintenance when the paper jamming has been occurred or when the recording paper and the heating element array have been scraped with each other in the paper jamming. Therefore, when the failure flag "0" is written in the flag memory 54, the cleaning treatment is performed immediately after turning on of the printer. In this cleaning treatment, unlike the case wherein the cleaning treatment is performed after printing, the color thermal recording paper 10 has not been drawn in the feeding path. Accordingly, the platen roller 21 is moved to the recording position after feeding of the paper, and then the thermal head

20 is cleaned by using of the cleaning portion 10*h*. Since the heating element array 23 is kept in a normal state by the cleaning treatment, the foreign matters are not fixed thereto by preheating prior to printing.

The foreign matters are likely to adhere to the thermal head 20 after performing of the initializing operation wherein the thermal head 20 and the platen roller 21 are in contact with each other, after the error resetting operation for unjamming and so forth, or after supplying or exchanging of the color thermal recording paper 10. In such a case, if the thermal head 20 is preheated before printing, to result in irrecoverable adhesion of the foreign matters. Thus, the cleaning treatment of the thermal head 20 is performed beforehand in order to prevent the foreign matters from fixing to the thermal head 20, as well as the case wherein the power-off operation has not been normally completed.

Furthermore, in this embodiment, the cleaning treatment is performed every completion of the printing; however, the cleaning treatment may be performed every completion of the predetermined number of obtained prints. In addition, in this embodiment, when the power-off operation has not been normally completed, the cleaning treatment is performed immediately after turning on of the printer. However, the cleaning treatment and the printing without preheating of the thermal head can prevent the foreign matters from being fixed to the thermal head. Likewise, the printing may be performed without preheating the thermal head after the initializing operation, or after the error resetting operation, or after the supplying and exchanging of the recording paper.

In addition, although the color thermal printer which is used with the long color thermal recording paper is explained in this embodiment, the color recording paper used with a cut sheet may be also applied. In this case, the cleaning treatment is performed by using a rear end margin of the color thermal recording paper. In the cleaning treatment except for case of performing after printing, it is necessary that the length of the rear end margin is more than the length L3, so that the size of the recording area 10*a* is smaller. Thereby, although one sheet of the recording paper is wasted, considering that the expensive cleaning sheet is used or disadvantage caused by the contamination of the thermal head, the cleaning method is very effective.

Furthermore, although the color thermal printer is explained as the example, a monochrome thermal printer, a dye sublimation printer, and wax transfer thermal printer may be applied to the present invention.

It is to be understood that the above-described embodiments are simply of the invention. Other embodiments may be devised by those skilled in the art which will embody the principal of the invention and fall within the sprit and scope thereof.

What is claimed is:

1. A cleaning method of cleaning a thermal head having a heating element array in which plural heating elements are arranged linearly, and said heating element array heating a thermal recording material in feeding and printing an image on a recording area, said cleaning method comprising the steps of;

contacting said heating element array with an outside of said recording area;

causing said heating element array to generate heat at cleaning temperature that is insufficient for said thermal recording material to develop color; and feeding said thermal recording material by a predetermined distance through between said heating element array and a platen, wherein said heating element array is cleaned by use of said thermal recording material.

2. A cleaning method as claimed in claim 1, wherein said thermal recording material includes plural thermosensitive coloring layers developing different colors, and said thermosensitive coloring layers are colored for printing in a frame sequential fashion.

3. A cleaning method as claimed in claim 2, wherein said plural thermosensitive coloring layers are respectively at least yellow, magenta and cyan thermosensitive coloring layers which are stacked sequentially on a printing surface of said thermal recording material;

said yellow thermosensitive coloring layer having the highest heat sensitivity develops yellow color by application of heat, and has a fixing property responsive to electro-magnetic radiations having a first wave-length range;

said magenta thermosensitive coloring layer of which heat sensitivity is middle develops magenta color by application of heat, and has a fixing property responsive to electro-magnetic radiations having a second wave-length range; and said cyan thermosensitive coloring layer having the lowest heat sensitivity develops cyan color by application of heat.

4. A cleaning method as claimed in claim 3, wherein said cleaning temperature is determined so that said cyan thermosensitive coloring layer will not develop said cyan color.

5. A cleaning method as claimed in claim 4, wherein said thermal recording material further includes a protective layer overlaid on said yellow thermosensitive coloring layer, said cleaning temperature is substantially lower than intermediate temperature at a median level between temperature for softening said protective layer and temperature for developing said cyan thermosensitive coloring layer to the highest density.

6. A cleaning method as claimed in claim 5, wherein said steps for cleaning are executed after recording of said cyan thermosensitive coloring layer.

7. A cleaning method as claimed in claim 5, wherein said thermal recording material is wound to a paper roll, said image is printed on said recording area after said thermal recording material has been drawn from said paper roll, and said recording area in which said image has been recorded is cut away.

8. A cleaning method as claimed in claim 7, wherein said steps for cleaning are executed by using a cleaning portion of said thermal recording material between said recording area in which said image has been recorded and a next recording area in which said image is not recorded.

9. A cleaning method as claimed in claim 8, wherein said cleaning portion used for said cleaning is cut away and then discarded.

10. A cleaning method as claimed in claim 7, wherein when a power source is turned off, power-off operation is performed for rewinding said thermal recording material to said paper roll, and when the power source is turned on, power-on operation is performed for drawing said thermal recording material from said paper roll.

11. A cleaning method as claimed in claim 10, wherein said steps for cleaning are executed after said power-on operation, if said power-off operation has not been normally completed.

12. A cleaning method as claimed in claim 10, wherein if said power-off operation has been normally completed, said image is started to be printed on said recording area after preheating of said heating element array, and if said power-off operation has not been normally completed, said image is started to be printed on said recording area without preheating said heating element array.

13. A cleaning method as claimed in claim 10, wherein said steps for cleaning are executed after said heating element array and said platen have been contacted with each other according to initializing operation for restoring an initial state of said thermal head, or after resetting of error, or after exchanging of said thermal recording material.

14. A cleaning method as claimed in claim 10, wherein in case of a normal printing operation, said image is started to be printed on said recording area after preheating of said thermal heating array; and after said heating element array and said platen have been contacted with each other according to said initializing operation for restoring the initial state of said thermal head, or after resetting of the error, or after exchanging of said thermal recording material, said image is started to be printed on said recording area without preheating of said thermal heating array.

15. A thermal printer having a thermal head, said thermal head having a heating element array in which plural heating elements are arranged linearly, said heating element array heating a thermal recording material which is held by a platen and printing an image on a recording area, said thermal recording material being rewound to a paper roll in accordance with a power-off operation, and drawn from said paper roll in accordance with a power-on operation, said thermal printer comprising:

checking means for checking whether said power-off operation has been normally completed; and a termination state memory for storing a termination state of said power-off operation transmitted from said checking means;

a controller for performing cleaning of said thermal head when said power-off operation has not been normally completed in reference to said termination state memory during said power-on operation, and when printing on said recording area has been completed, said cleaning including steps of:

(A) pressing said heating element array against an outside of said recording area;

(B) causing said heating element array to generate heat at cleaning temperature that is insufficient for said thermal recording material to develop color; and (C) feeding said thermal recording material by a predetermined distance through between said heating element array and said platen, said heating element array being cleaned by use of said thermal recording material.

16. A thermal printer as claimed in claim 15, wherein said thermal recording material includes at least yellow, magenta, and cyan thermosensitive coloring layers which are stacked sequentially on a printing surface of said thermal recording material;

said yellow thermosensitive coloring layer having the highest heat sensitivity develops yellow color by application of heat, and has a fixing property responsive to electro-magnetic radiations having a first wave-length range;

said magenta thermosensitive coloring layer of which heat sensitivity is middle develops magenta color by application of heat, and has a fixing property responsive to electro-magnetic radiations having a second wave-length range; and said cyan thermosensitive coloring layer having the lowest heat sensitivity develops cyan color by application of heat.

17. A thermal printer as claimed in claim 16, wherein said thermal recording material further includes a protective layer overlaid on said yellow thermosensitive coloring layer, said cleaning temperature is substantially lower than intermediate temperature at a median level between temperature for softening said protective layer and temperature for developing said cyan thermosensitive coloring layer to the highest density.

18. A thermal printer having a thermal head, said thermal head having a heating element array in which plural heating elements are arranged linearly, said heating element array heating a thermal recording material which is held by a platen and printing an image on a recording area, said thermal recording material being rewound to a paper roll in accordance with a power-off operation, and drawn from said paper roll in accordance with a power-on operation, said thermal printer comprising:

a controller for performing cleaning of said thermal head after printing on said recording area has been completed, said cleaning including steps of;

(A) pressing said heating element array against an outside of said recording area;

(B) causing said heating element array to generate heat at cleaning temperature that is insufficient for said thermal recording material to develop color; and (C) feeding said thermal recording material by a predetermined distance through between said heating element array and said platen, said heating element array being cleaned by use of said thermal recording material;

checking means for checking whether said power-off operation has been normally completed; and a termination state memory for storing a termination state of said power-off operation transmitted from said checking means;

wherein said controller further judges whether preheating of said thermal head should be executed by referring to said termination state memory, and executes said preheating prior to printing on said recording area if said power-off operation has been normally completed, and suppresses said preheating if said power-off operation has not been normally completed.

19. A thermal printer as claimed in claim 18, wherein said thermal recording material includes at least yellow, magenta, and cyan thermosensitive coloring layers which are stacked sequentially on a printing surface of said thermal recording material;

said yellow thermosensitive coloring layer having the highest heat sensitivity develops yellow color by application of heat, and has a fixing property responsive to electro-magnetic radiations having a first wave-length range;

said magenta thermosensitive coloring layer of which heat sensitivity is middle develops magenta color by application of heat, and has a fixing property responsive to electromagnetic radiations having a second wave-length ranges; and said cyan thermosensitive coloring layer having the lowest heat sensitivity develops cyan color by application of heat.

20. A thermal printer as claimed in claim 19, wherein said thermal recording material further includes a protective layer overlaid on said yellow thermosensitive coloring layer, said cleaning temperature is substantially lower than intermediate temperature at a median level between temperature for softening said protective layer and temperature for developing said cyan thermosensitive coloring layer to the highest density.

* * * * *